United States Patent [19]

Giggard

[11] 4,165,018

[45] Aug. 21, 1979

[54] CHILD RESISTANT OVERCAP FOR EASY OPENING CONTAINER

[75] Inventor: Earl D. Giggard, Clarendon Hills, Ill.

[73] Assignee: The Continental Group, Inc., New York, N.Y.

[21] Appl. No.: 938,621

[22] Filed: Aug. 31, 1978

[51] Int. Cl.[2] ..... B65D 43/26

[52] U.S. Cl. ..... 220/284; 220/257; 220/266; 220/306

[58] Field of Search ..... 220/265, 266, 284, 306, 220/257; 215/250, 253, 256, 317; 222/541, 182

[56] References Cited

U.S. PATENT DOCUMENTS

| | | | |
|---|---|---|---|
| 3,414,167 | 12/1968 | Osrow | 222/182 |
| 3,770,156 | 11/1973 | Yates | 215/250 |

*Primary Examiner*—George T. Hall

*Attorney, Agent, or Firm*—Charles E. Brown

[57] ABSTRACT

A child resistant overcap which is engageable over an end of an easy opening container for preventing access to the easy opening feature of such container. The interlock between the overcap and the container is such as to require rupture of a rupturable section of a skirt of the overcap utilizing a tool before the overcap can be removed to provide access to the easy opening feature of the container.

9 Claims, 6 Drawing Figures

CHILD RESISTANT OVERCAP FOR EASY OPENING CONTAINER

This invention relates in general to new and useful improvements in containers, and more particularly to improvements relating to containers of the easy opening type.

Easy opening containers, particularly those wherein the end unit is provided with a dispensing opening having means for effecting the opening thereof or the removal of a panel portion defining the same, are traditionally so constructed whereby they may be opened with a minimum of force. Thus, the customary easy opening container may be opened by children. There are, of course, many products packaged in easy opening containers which if consumed by a child would be highly detrimental.

In accordance with this invention, it is proposed to provide containers having easy opening end units with overcaps. While it is customary to provide overcaps for containers which are readily removable and which overcaps are intended solely for the purpose of reclosing the containers, such overcaps are readily removable by children and thus cannot in any way be considered a safeguard.

In accordance with this invention, it is proposed to provide an overcap for a container having an easy opening end unit wherein the interlock between the overcap and the container is such that it cannot be readily removed. Further, it is proposed in accordance with this invention to provide an overcap having an interlocking relationship with a container such that a tool is required to effect the opening thereof.

Most particularly, in accordance with this invention it is proposed to provide an overcap which will lock beneath the customary double seam between an end unit and a container body with sufficient tightness so as to make it substantially impossible for the overcap to be removed as a unit even by a relatively strong adult.

In accordance with this invention, there is provided an overcap which includes an end panel and a depending skirt and wherein the skirt is constructed with locking means particularly adaptable to be engaged beneath the customary double seam securing the end unit to the container body, and wherein the skirt is provided with a rupturable section which must be displaced before the skirt may be distended sufficiently to effect the removal thereof from an associated container.

Further in accordance with this invention, the skirt of the overcap is provided with means wherein a suitable tool, such as a screwdriver or pointed knife, may engage the rupturable section and effect the rupturing thereof, whereby the skirt of the overcap may be distended to effect removal thereof.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
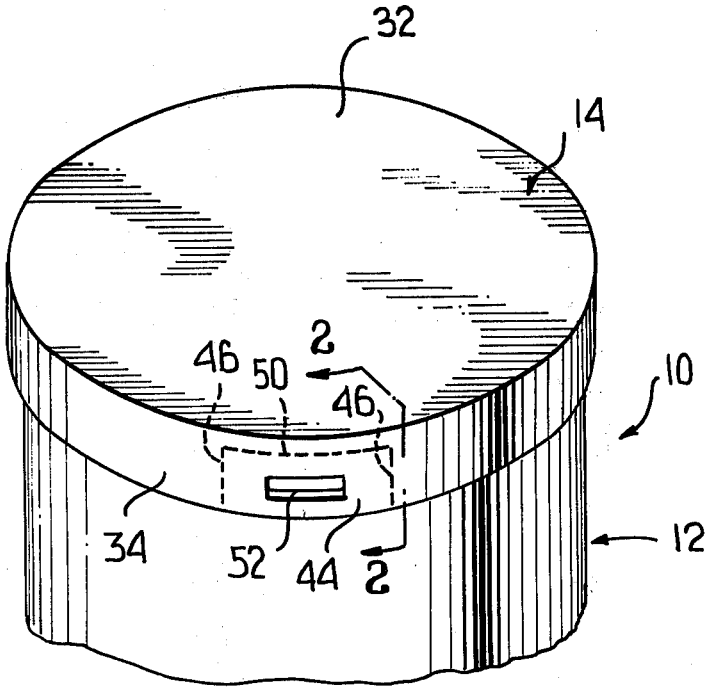
FIG. 1 is a fragmentary top perspective view of a conventional easy opening container having mounted thereon an overcap formed in accordance with this invention.

Referring now to the drawings in detail, it will be seen that there is illustrated a container assembly formed in accordance with this invention, the container assembly being generally identified by the numeral 10. The container assembly 10 includes a conventional easy opening container, generally identified by the numeral 12, which is provided with a child proof overcap 14.

It is to be understood that the container 12 is of a conventional construction and that the details thereof may be modified without departing from the spirit of the invention. Most particularly, the container 12 will include a body 16 having secured thereto by means of a conventional double seam 18 an easy opening end unit 20. The easy opening end unit 20 includes an end panel 22 which is illustrated as having a removable panel portion 24 defined by a weakening line 26 and having attached thereto by way of a rivet 28 a pull or opening tab 30.

It is to be understood that the easy opening feature does not constitute a specific part of this invention and that it may be varied and may include an end panel having preformed openings therein closed by a pull tape.

This invention most particularly relates to the overcap 14 and the modified container assembly 10 effected by the incorporation of the overcap on an easy opening container, such as the container 12.

Most specifically, the overcap 14 includes an end panel 32 having a depending peripheral skirt 34. The skirt 34 is of a size to be telescoped over the double seam 18 and is of a height to extend a material distance therebelow. The overcap 14 is of a molded plastics material construction and the skirt 34 has integrally formed with the inner surface thereof a projecting rib 36. The rib 36 is generally of a V-shaped cross section and has a lower camming surface 38 and an upper locking surface 40.

It is to be understood that the overlap 14 may be readily applied to the container 12 by centering the overcap on the container 12 and then exerting a relatively heavy downwardly directed force on the overcap sufficient to effect the outward camming of the skirt 34 by the engagement of the camming surface 38 of the rib 36 with the double seam 18. After the rib 36 passes below the level of the double seam 18, the rib 36 will immediately snap back to its original position with the locking surface 40 engaging beneath the double seam 18 and locking the overcap 14 in place on the container 12.

It would not be impossible for an adult to remove the overcap 14 from the container 12 utilizing prying tools. However, it is to be understood that the interlock between the overcap 14 and the container 12 is one where sufficient force would be required outwardly to distend the skirt 34 so as to prevent the removal of the overcap by a child.

Figure 3:
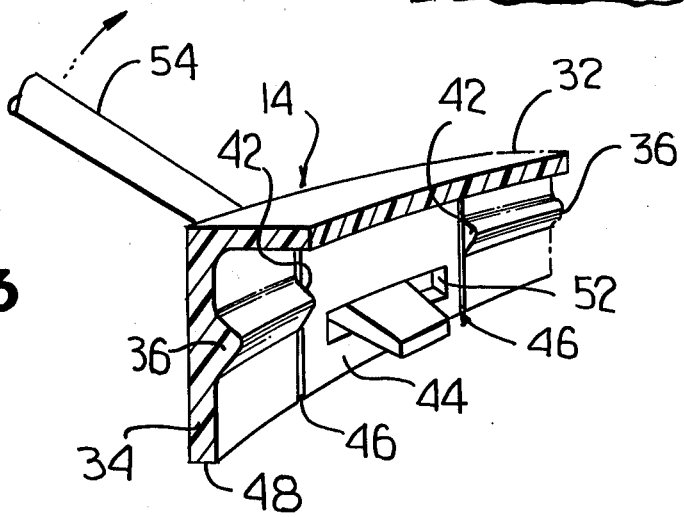
FIG. 3 is an enlarged fragmentary perspective view of that portion of the overcap having formed therein the rupturable section, the screwdriver being illustrated in position to effect rupture.

Referring now to FIG. 3 in particular, it will be seen that the rib 36 is interrupted and has spaced end portions 42. Between the end portions 42 of the rib 36, the skirt 34 is provided with a rupturable section 44. The rupturable section 44 is defined by a pair of weakening lines 46, preferably formed on the inner surface of the skirt 34. The weakening lines 46 extend generally in the height direction of the skirt 34 and substantially open through the lower free edge 48 of the skirt 34. With particular reference to FIG. 1, it is pointed out that if the rupturable section 44 is to be removed, a further weakening line 50 may be formed in the skirt 34 on the inner surface thereof and extending between the ends of the weakening lines 46 remote from the free edge 48.

Figure 2:
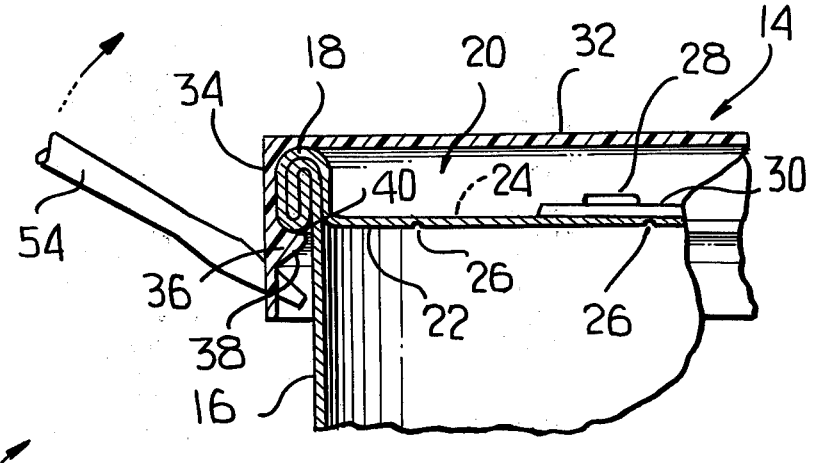
FIG. 2 is an enlarged fragmentary vertical sectional view taken generally along the line 2—2 of FIG. 1, and shows a screwdriver in position for effecting the rupture of the rupturable section.

In order to facilitate the at least partial separation of the rupturable section 44 from the remainder of the skirt 34, there is provided in the rupturable section 44 a tool receiving opening 52 which is preferably in the form of a slot which extends generally parallel to the lower free edge 48. The slot or opening 52 is partibularly adapted to have the blade of a screwdriver 54 inserted therethrough in the manner best shown in FIGS. 2 and 3. Once the screwdriver blade has been wedged into the opening 52, the screwdriver may be rotated upwardly as indicated by the arrow in each of FIGS. 2 and 3 to effect the rupture of the skirt 34 at least along the weakening lines 46.

Once the continuity of the skirt 34 has been interrupted, it no longer has the initial great resistance to removal in that it may now be readily distended outwardly, and thus the skirt 34 may be distended outwardly sufficiently for the rib 36 progressively to disengage from beneath the double seam 18.

It is to be understood that the overcap 14, since it requires a tool for its removal, is considered to be child proof and therefore it is considered to be a child proof closure. While the overcap 14 is usable but once, it is to be understood that the interlock between the rib 36 and the seam 18 is sufficient to permit the overcap 14 to be usable for reclosing the container 12.

Figure 4:
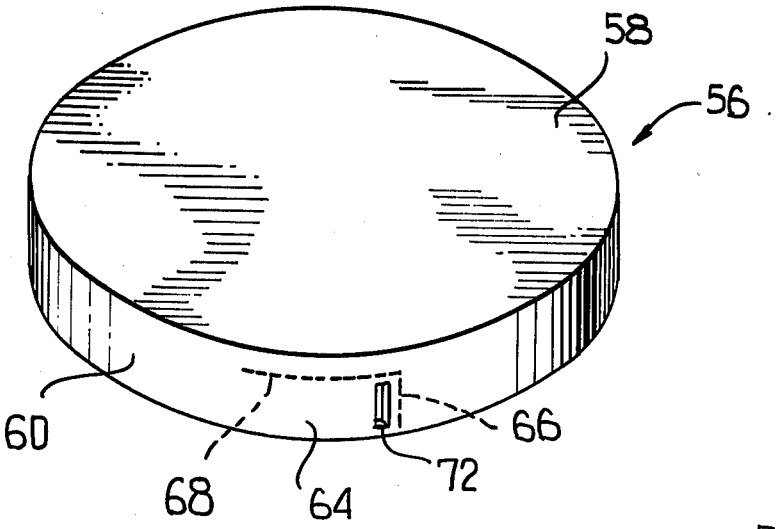
FIG. 4 is a top perspective view of a slightly modified form of overcap.
Figure 5:
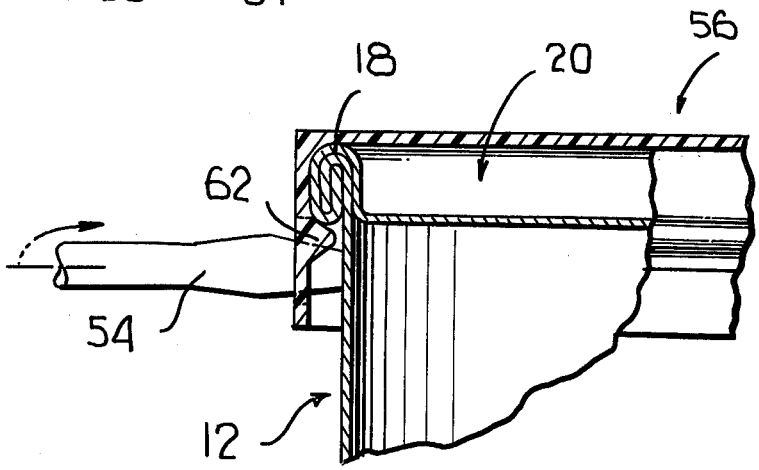
FIG. 5 is a sectional view similar to FIG. 2 showing a screwdriver in position for initiating the removal of the overcap.
Figure 6:
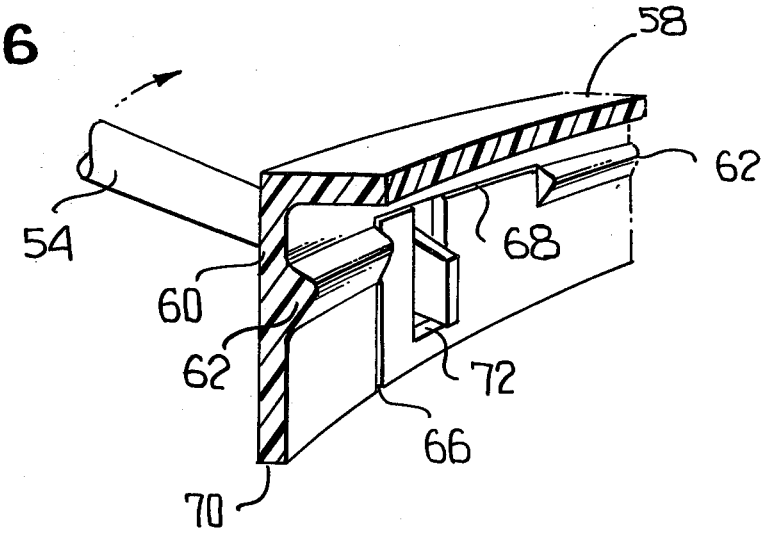
FIG. 6 is a fragmentary perspective view similar to FIG. 3, and shows further the details of the overcap of FIG. 4.

A modified form of overcap is illustrated in FIGS. 4–6 and is generally identified by the numeral 56. The overcap 36 is of the same general construction as the overcap 14 and includes an end panel 58 having depending therefrom a continuous skirt 60. The overcap 56 has the same locking relationship with respect to a container, such as the container 12, as is best shown in FIG. 5. The skirt 60 has formed on the inner surface thereof the same rib construction as the rib 36 with the illustrated rib being identified by the numeral 62. The rib 62 is engaged beneath the double seam 18 securing the easy opening end 20 to the container body 12.

The overcap 56 differs from the overcap 14 in the opening feature thereof. The overcap 56 has formed in the skirt thereof a rupturable section 64 which is generally defined by weakening lines 66, 68 preferably formed as scores in the inner surface of the skirt 60. It is to be noted that the weakening line 66 extends in the height direction of the skirt 60 generally from the lower free edge 70 of the skirt 60 upwardly. The weakening line 68 is joined to the upper end of the weakening line 66 and extends therefrom generally about the skirt 64 generally parallel to the free lower edge 70 of the skirt.

With particular reference to FIG. 6, it will be seen that the rib 62 terminates on opposite sides of the rupturable section 64 so as to facilitate the necessary outward displacement of the rupturable section 64 without too great resistance. It is to be understood that rupture must be initiated along the weakening line 66, followed by rupture along the weakening line 63 and that the rupturable section 64 will merely hinge with respect to the remainder of the skirt 60 after rupture of the skirt 60 along the weakening lines 66 and 68 has been concluded. In order to facilitate rupture of the skirt 60 along the weakening lines 66 and 68, the rupturable section 64 is provided with a tool receiving opening preferably in the form of an upstanding slot 72 which is particularly adapted to receive the blade of the screwdriver 54 or the pointed end of a knife or like tool. After the tip of the blade of the screwdriver 54 has been inserted through the opening 72, the screwdriver is pivoted in the direction shown by the arrow in each of FIGS. 5 and 6 with the resultant rupture of the skirt along the weakening line 66, followed by peripheral rupture of the skirt 64 along the weakening line 68.

Once the rupturable section 64 has been defined by rupturing of the skirt 60 along the weakening lines 66, 68, the skirt 60 has lost its continuity and may be readily spread sufficiently to effect the removal of the overcap 56.

It is to be understood that the overcap 56 is molded of a suitable plastics material in the same manner as is the overcap 14 and that it is readily applied to the container 12 by merely exerting a sufficiently great downward force on the overcap 56 after it has been initially telescoped over the upper portion of the double seam 18.

Although only two forms of opening devices for effecting the rupture of the skirt of the overcap have been specifically illustrated and described, it is to be understood that other types of rupturable sections may be provided.

I claim:

1. A child resistant overcap for use with containers having a peripheral projection, said overcap comprising an end panel having a continuous depending peripheral skirt, locking means on said skirt for snap interlocking engagement with a container peripheral projection to retain said overcap against removal, said skirt having a rupturable section defined by at least two weakening lines, and a tool receiving opening in said rupturable section for receiving a tool to effect rupture of said skirt along said weakening lines, said skirt having a free lower edge and at least one of said weakening lines extending generally in the height direction of said skirt and at least substantially to said skirt free lower edge.

2. The child resistant overcap of claim 1 wherein said locking means has spaced ends disposed on opposite sides of said rupturable section and is continuous between said ends.

3. The child resistant overcap of claim 1 wherein another of said weakening lines extends generally parallel to said skirt free lower edge generally from that end of said one weakening line disposed remote from said skirt free lower edge.

4. The child resistant closure of claim 3 wherein said tool receiving opening is a slot extending generally normal to said skirt free lower edge.

5. The child resistant overcap of claim 1 wherein a second of said weakening lines is spaced around said skirt from said one weakening line and also extends generally in the height direction of said skirt and at least substantially to said skirt free lower edge.

6. The child resistant closure of claim 5 wherein said tool receiving opening is a slot extending generally parallel to said skirt free lower edge.

7. The child resistant closure of claim 1 wherein said closure is engaged on a container having an end unit of the easy opening type, said end unit is secured to the remainder of said container by a projecting seam, and said locking means being engaged beneath said projecting seam with a tightness normally preventing removal without rupture of said skirt.

8. The child resistant closure of claim 7 wherein said tool receiving opening is disposed below said projecting seam.

9. The child resistant closure of claim 1 wherein said locking means lies in a general plane, and said tool receiving slot is disposed below said locking means general plane.

* * * * *